US005681250A

United States Patent [19]

Hoover et al.

[11] Patent Number: 5,681,250

[45] Date of Patent: Oct. 28, 1997

[54] COMBINATION CHAIR AND EXERCISE APPARATUS AND METHOD THEREFOR

[76] Inventors: Richard L. Hoover, 5928 E. Dynamite Blvd., Carefree, Ariz. 85377; Wendy Rountree, 137 W. Libby St., Phoenix, Ariz. 85023

[21] Appl. No.: 607,181

[22] Filed: Feb. 26, 1996

[51] Int. Cl.[6] ..... A63B 26/00

[52] U.S. Cl. ..... 482/142; 482/96

[58] Field of Search ..... 482/142, 96, 114

[56] References Cited

U.S. PATENT DOCUMENTS

| | | | |
|---|---|---|---|
| D. 224,422 | 7/1972 | Beach | 482/142 |
| 3,491,998 | 1/1970 | Lyon | 482/142 |
| 3,589,715 | 6/1971 | Mark | 482/142 |
| 3,767,190 | 10/1973 | Biggerstaff | 482/142 |

*Primary Examiner*—Lynne Reichard

*Attorney, Agent, or Firm*—Harry M Weiss; Jeffrey D. Moy; Harry M. Weiss & Associates, P.C.

[57] ABSTRACT

The present invention is directed to a combination chair and exercise apparatus. The combination chair and exercise apparatus is preferably comprised of a collapsible chair frame, mounted on a collapsible base, with rotation and pivoting points located on the frame and base so as to permit a user of the combination chair and exercise apparatus to bend the spine in either direction with respect to a lower portion of the user's body. In an alternative embodiment, the combination chair and exercise apparatus is non-collapsible. When not used for exercising, the combination chair and exercise apparatus may be used as a chair.

4 Claims, 3 Drawing Sheets

COMBINATION CHAIR AND EXERCISE APPARATUS AND METHOD THEREFOR

BACKGROUND OF THE INVENTION

1. Field of Invention

This invention relates generally to exercise equipment and, more specifically, to a combination chair, aerobic and abdominal exerciser, and back stretching device and method therefor.

2. Background of the Invention

Generally, exercise equipment, including home exercise equipment, is built for one general purpose only—to be used for exercising. Thus, stationary bicycles are used for stationary bicycling, rowing machines are used for rowing, treadmills are used for walking and running, cross-country skiing machines are used for simulated cross-country skiing, and so on. Conversely, although it is intended that home exercise equipment will be used in a home, such equipment is not generally designed to also serve as a piece of furniture—such as a chair. As a result, a person desiring to own exercise equipment must separately purchase both furniture and the particular piece of exercise equipment. Moreover, such a person must also have or create additional space to house the particular piece of exercise equipment. Still further, if an owner of exercise equipment tires of using that particular piece of equipment, or becomes physically unable to do so, the owner will have no other use for that piece of equipment and must either dispose of or store the unused exercise apparatus.

According to a recent news report, there a number of reasons why people quit exercising. One such reason is that people interested in beginning an exercise program often have not relegated an area in their home to exercise—something that would not be a problem if an exercise apparatus also served as furniture. Another reason why people quit exercising is that, with certain kinds of equipment, they cannot hear the television while exercising—thus, quiet exercise equipment is preferred over loud exercise equipment. Other reasons include that exercise is boring, and that exercise equipment is uncomfortable.

Therefore, a need existed to provide an improved exercise apparatus and method, which is capable of serving as a chair-type item of furniture when not in use for exercising purposes. The improved exercise apparatus must also operate in a fairly quiet manner, so that even when in use for exercising purposes, the user can hear a nearby television set. On the other hand, the improved exercise apparatus and method should also be collapsible and portable, so that a user will have the option of storing or transporting the apparatus when not in use, in the event that the user does not desire to also use the apparatus as a chair-type piece of furniture.

SUMMARY OF THE INVENTION

It is an object of the present invention to provide an improved multiple-purpose exercise apparatus and chair.

It is an object of this invention to provide an apparatus for exercising, in particular, doing back stretching and sit-ups.

It is another object of this invention to provide an apparatus for exercising that is portable.

It is another object of this invention to provide an apparatus for exercising that is light and collapsible.

It is another object of this invention to provide an apparatus for exercising that is comfortable to be used for sitting or relaxing.

BRIEF DESCRIPTION OF THE PREFERRED EMBODIMENTS

In accordance with one embodiment of the present invention, a combination chair and exercise apparatus is disclosed. The combination chair and exercise apparatus is comprised of seat means for supporting a lower portion of a person's body; the seat means comprising foot support means for supporting both feet of a person using the combination chair and exercise apparatus; back support means coupled to the seat means for supporting an upper portion of a person's body; the back support means comprising handle means located at an upper portion of the back support means for permitting a person using the combination chair and exercise apparatus to grasp and maneuver the back support means; rotatable coupling means located at a confluence of the seat means and the back support means for permitting the seat means and the back support means to move relative to one another; base means rotationally coupled to lower side portions of the back support means for supporting the back support means and for permitting the back support means to rotate relative to the base means and relative to the seat means; and pivoting coupling means coupling the base means and the seat means for supporting the seat means and for permitting the seat means to move relative to the back support means.

In accordance with another embodiment of the present invention, a combination chair and exercise apparatus is disclosed. The combination chair and exercise apparatus is comprised of seat means for supporting a lower portion of a person's body; and pivotable back support means pivotably coupled to the seat means for both supporting an upper portion of a person's body and for pivoting an upper portion of a person's body front and back flexing the person's spine in both directions relative to a prone position.

In accordance with a further embodiment of the present invention, a method for providing a combination chair and exercise apparatus is disclosed. The method comprises the steps of: providing seat means for supporting a lower portion of a person's body; the seat means comprising foot support means for supporting both feet of a person using the combination chair and exercise apparatus; providing back support means coupled to the seat means for supporting an upper portion of a person's body; the back support means comprising handle means located at an upper portion of the back support means for permitting a person using the combination chair and exercise apparatus to grasp and maneuver the back support means; providing rotatable coupling means located at a confluence of the seat means and the back support means for permitting the seat means and the back support means to move relative to one another; providing base means rotationally coupled to lower side portions of the back support means for supporting the back support means and for permitting the back support means to rotate relative to the base means and relative to the seat means; and providing pivoting coupling means coupling the base means and the seat means for supporting the seat means and for permitting the seat means to move relative to the back support means.

In accordance with a still further embodiment of the present invention, a method for providing a combination chair and exercise apparatus is disclosed. The method comprises the steps of: providing seat means for supporting a lower portion of a person's body; and providing pivotable back support means pivotably coupled to the seat means for both supporting an upper portion of a person's body and for pivoting an upper portion of a person's body front and back flexing the person's spine in both directions relative to a prone position.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
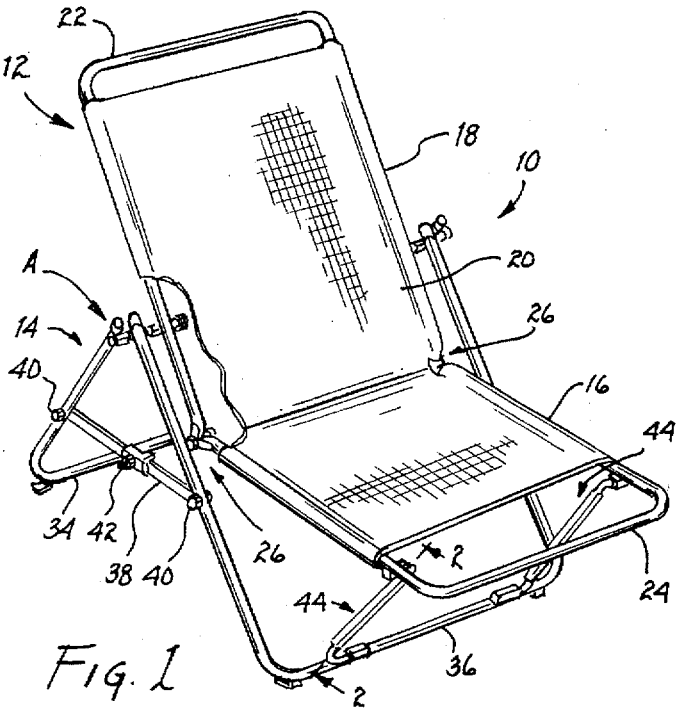
FIG. 1 is a perspective view of one embodiment of the combination chair and exercise apparatus of the present invention.

Referring to the embodiment of FIGS. 1, 5, 6, and 8, reference number 10 refers generally to the combination chair and exercise apparatus of this invention. The chair and exercise apparatus 10 comprises a substantially rectangular chair frame 12 and a base frame 14. Preferably, the chair frame 12 and the base frame 14 are made from a tubular steel or other like material. The chair frame 12 comprises, in turn, a substantially rectangular seat portion 16 and a substantially square back support portion 18, each of which are open at one end thereof and which seat portion 16 and back support portion 18 are joined at their respective open ends (See FIG. 3B). Substantial portions of the seat portion 16 and the back support portion 18 are covered by cover 20, which cover 20 is secured to the side portions of seat portion 16 and back support portion 18. The cover 20 may be secured to the side portions of seat portion 16 and back support portion 18 in a number of different ways that are known in the art, including by stitching the cover 20 around the side portions, or by bolting or otherwise fastening the cover 20 to the side portions. The cover 20 may be fabricated from virtually any material commonly used to cover furniture. The cover 20 ends below the top 22 of the back support portion 18, so that a user (not shown) may reach back and directly grasp the top 22 during exercise. The cover 20 ends above the bottom 24 of the seat portion 16, so that a user may lift his or her feet and place them onto the bottom 24 during exercise.

Figure 3A:
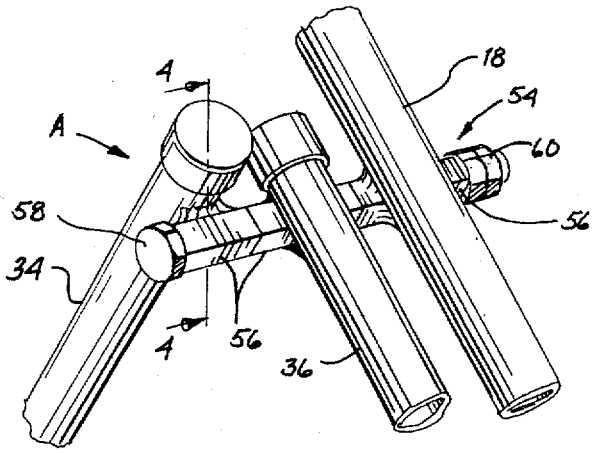
FIG. 3A is a close-up elevated view of the rotatable connection between the base and the back portion of the combination chair and exercise apparatus of the present invention.
Figure 3B:
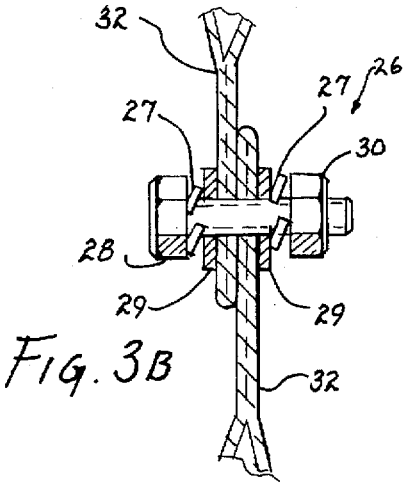
FIG. 3B is a close-up side view of the rotatable connection between the seat and back portions of the combination chair and exercise apparatus of the present invention.

Referring briefly to FIG. 3B, the seat portion 16 and the back support portion 18 are rotatably joined at their respective open ends by coupling apparatuses 26. These apparatuses 26 comprise a bolt 28 which is inserted through corresponding openings (not shown) in the end portions of seat portion 16 and back support portion 18, and at least one nut 30 secured to the bolt 28. The end portions of the seat portion 16 and the back support portion 18 in which the openings (not shown) are located comprise flat sides 32 on both sides thereof, which flat sides 32 can be placed together so as to permit the insertion through the openings therein of the bolt 28. In order to achieve sufficient friction so that the bottom 24 and the back support portion 18 maintain their positions relative to one another when the chair and exercise apparatus 10 is not in use, lock washers 27 and washers 29 are placed on either side of the flat sides 32 in the following order—nut, 30, lock washer 27, washer 29, flat sides 32, washer 29, lock washer 27, and bolt 28. It is possible to vary this order, or to add additional nuts, washers, or lock washers, to achieve the desired friction and without departing from the spirit or scope of this invention.

Figure 6:
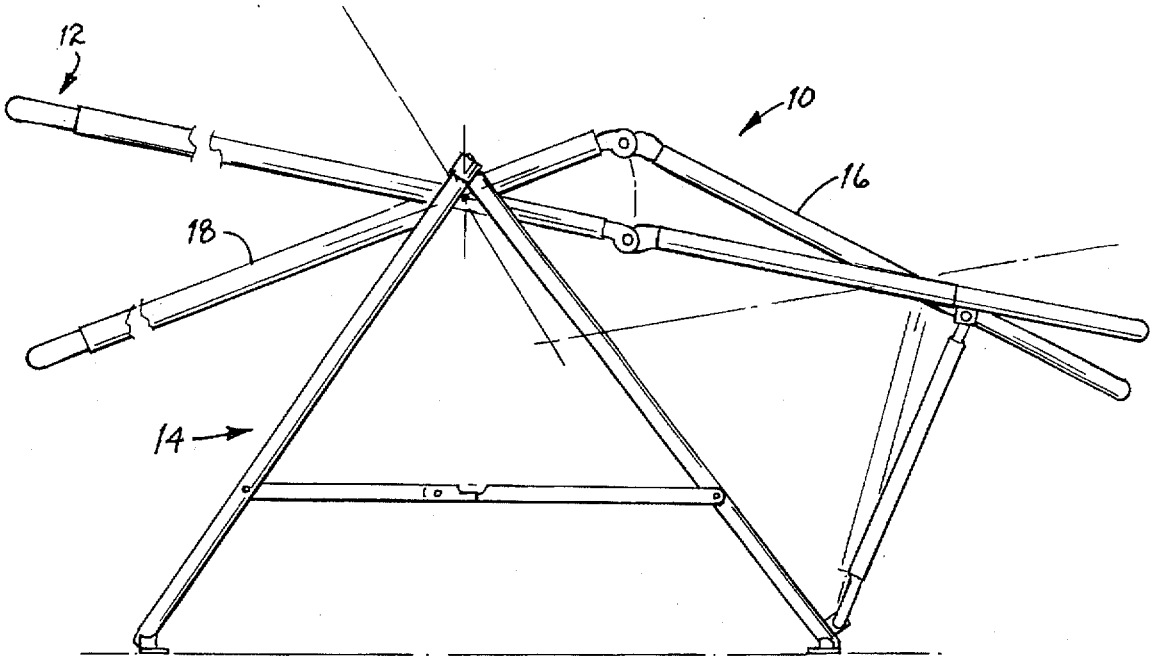
FIG. 6 is a side view of the combination chair and exercise apparatus of the present invention, with alternative positions of the seat and back portions shown in phantom.

Referring again to FIGS. 1 and 6, the base portion 14 comprises a first, open-ended substantially rectangular portion 34 which is located substantially below the back support portion 18 and an second, open-ended substantially rectangular portion 36 which is located substantially below the seat portion 16. The first and second rectangular portions 34 and 36 are preferably coupled at two points. The first coupling apparatus is located at the meeting of the first and second rectangular portions 34 and 36 and is shown in FIG. 3A. The second coupling apparatus comprises longerons 38, of the type that are common in collapsible furniture, which join the side portions of the first and second rectangular portions 34 and 36. The longerons are rotatably coupled to the first and second rectangular portions 34 and 36 with bolts 40, and rotate in the middle about bolt 42. FIG. 6 shows several of the positions of the bottom 24 and the back support portion 18 relative to one another, when the chair and exercise apparatus 10 is in use.

Figure 2:
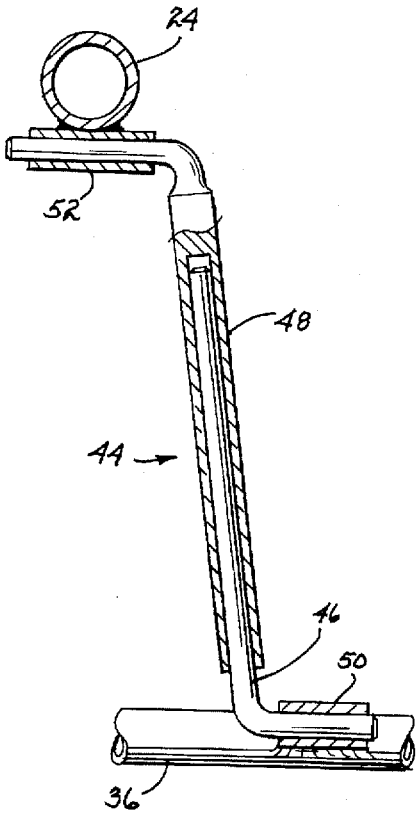
FIG. 2 is a cross-sectional view of the pivoting coupling means coupling the base and seat and of the present invention, taken along line 2—2 of FIG. 1.

Referring to FIG. 2, telescoping support means 44 are shown. Each of the two support means 44 comprises a substantially L-shaped male connecting member 46 and a substantially L-shaped connecting member 48. The longer end of the L-shaped connecting member 48 is hollow, for receiving the long end of male connecting member 46. The shorter end of the male connecting member 46 is pivotably coupled to the second rectangular portion 36 by insertion into a complimentary female member 50 located on the second rectangular portion 36. The shorter end of the L-shaped connecting member 48 is coupled to the bottom 24 by insertion into a complimentary female member 52 located on the bottom 24. Preferably, the longer end of each of the L-shaped connecting member 48 is angled inward toward the other longer end of each of the L-shaped connecting member 48 at an angle of approximately 10 degrees.

Figure 4:
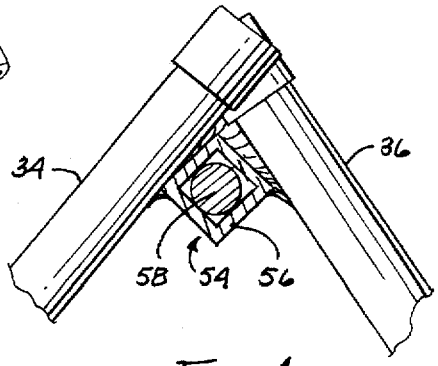
FIG. 4 is a cross-sectional view of the rotatable connection between the base and the back portion of the combination chair and exercise apparatus of the present invention, taken along line 4—4 of FIG. 3A.
Figure 5:
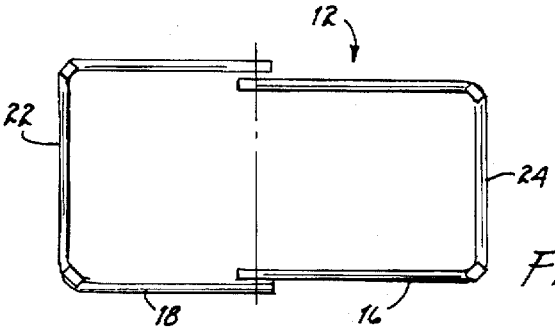
FIG. 5 is a top skeletal view of the seat and back portions of the combination chair and exercise apparatus of the present invention.

Referring to FIGS. 3A and 4, the connection between the back support portion 18 and the base portion 14 is shown. Connected just below the top portions of the first and second rectangular portions 34 and 36, is a rotation apparatus 54. The rotation apparatus comprises interlocking, substantially rectangular housing members 56, which are welded or otherwise coupled to the first and second rectangular portions 34 and 36 and to the back support portion 18, and which are joined by bolt 58 and at least one nut 60.

Figure 7:
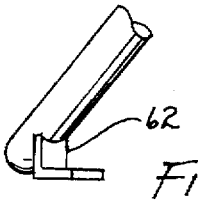
FIG. 7 is a side view of one of the L-shaped stabilizing legs connected to the base portion of the combination chair and exercise apparatus of the present invention.
Figure 8:
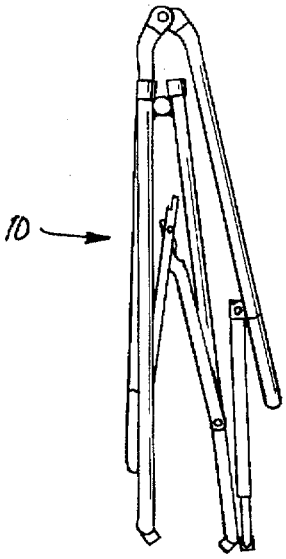
FIG. 8 is a side view of the combination chair and exercise apparatus of the present invention in the collapsed position.

Referring to FIG. 7, shown is one of four L-shaped stabilizing members 62, which stabilizing members 62 are located at substantially the four closed corners of the first and second rectangular portions 34 and 36. These stabilizing members 62 provide additional support and stability during use of the chair and exercise apparatus 10.

Figure 9:
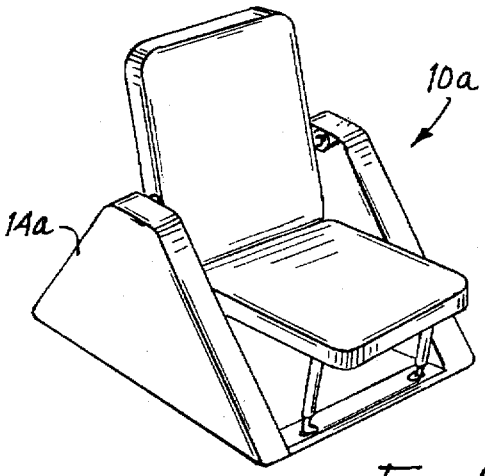
FIG. 9 is an elevated view of a another embodiment of the combination chair and exercise apparatus of the present invention, in which the apparatus is not collapsible.

Referring to FIG. 9, an alternative embodiment of the chair and exercise apparatus 10 of the present invention. This embodiment discloses a non-collapsible chair and exercise apparatus 10*a*, in which the base portion 14*a* is fixed into position and is not collapsible in the same manner as the base portion 14 of the preferred embodiment. This non-collapsible chair and exercise apparatus 10*a* would be appropriate for use in a fixed location, where the element of collapsibility would not be necessary.

Figure 11:
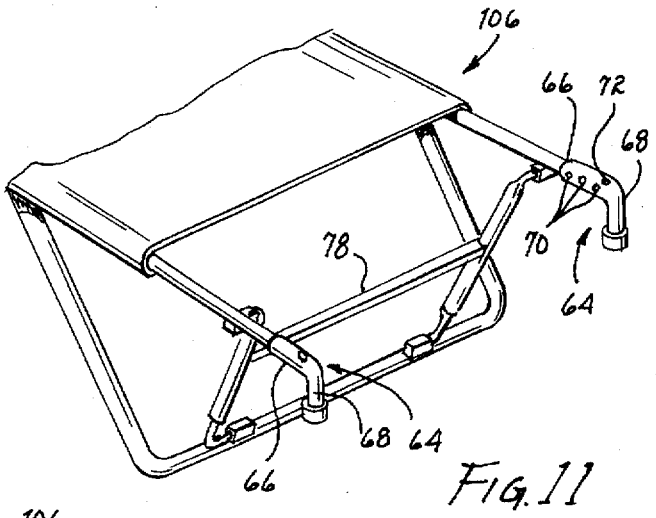
FIG. 11 is a perspective view of a front portion of the embodiment of the combination chair and exercise apparatus shown in FIG. 10.
Figure 10:
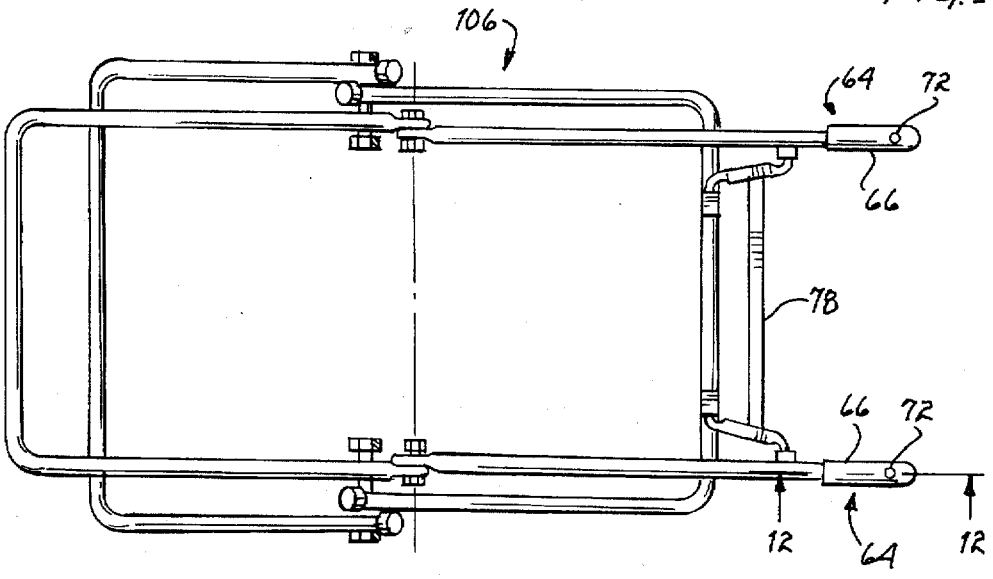
FIG. 10 is a top skeletal view of another embodiment of the combination chair and exercise apparatus of the present invention, in which a pair of telescopic foot supports replace the foot support bar shown in the embodiment disclosed in FIG. 1.
Figure 13:
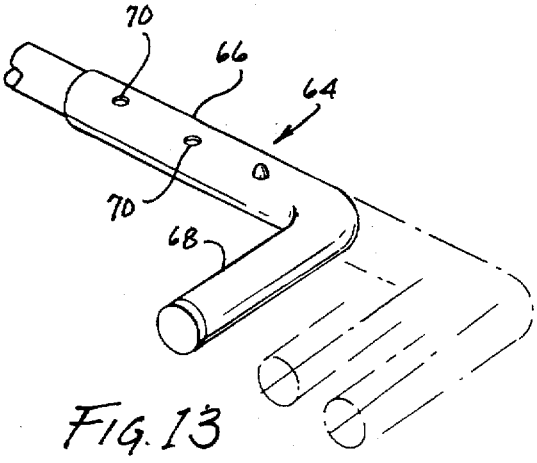
FIG. 13 is a close-up top view of one of the telescopic foot supports of the embodiment of the combination chair and exercise apparatus shown in FIG. 10.
Figure 12:
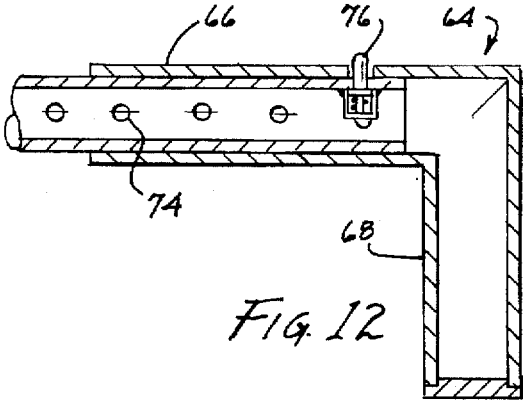
FIG. 12 is a cross-sectional view of one of the telescopic foot supports of the embodiment of the combination chair and exercise apparatus shown in FIG. 10, taken along line 12—12 of FIG. 10.

Referring to FIGS. 10 and 11, yet another alternative embodiment of the chair and exercise apparatus 10 of the present invention. This embodiment discloses a collapsible chair and exercise apparatus 10*b*, which is identical in all respects to the preferred embodiment of the chair and exercise apparatus 10, except that the bottom 24 located between the telescoping support means 44 in the embodiment shown in FIG. 1 is removed so as not to interfere with the legs of a user of the chair and exercise apparatus 10*b* in the sitting position. In its place, there are two L-shaped telescoping foot supports 64, comprising a longer portion 66 and a shorter portion 68. The longer portion 66 of the foot supports 64 is hollow and has an internal circumference that is slightly larger than the exterior circumference of the tubes comprising the seat portion 16. The longer portion 66 has a plurality of holes 70 arranged in a line, and displaced on the longer portion 66 so that when the foot supports 64 are swiveled so that the open ends of the shorter portions 68 face each other, the plurality of holes 70 are on a top portion of the longer portion 66. The longer portion 66 also has at least one hole 72, which is displaced on the longer portion 66 so that when the foot supports 64 are swiveled so that the open ends of the shorter portions 68 face directly down to the ground, the hole 72 is on a top portion of the longer portion 66. At the end of the side portion of the seat portion 16 which receives the foot supports 64, there is at least one hole 74 or, alternatively, at least one spring-loaded pin 6, which hole 74 or spring-loaded pin 76 may be lined up with one of the holes 70 or hole 72. (See FIG. 12). If the end of the side portion of the seat portion 16 has a hole 74 rather than a spring-loaded pin 76, the user may insert a pin (not shown) through a hole 70 or 72 and into hole 76, so as to secure the foot support 64 in position relative to the seat portion 16. To maintain horizontal stability of the seat portion 16 during use, a bar 78 is connected to each of the two L-shaped connecting members 48. The cover 20 maintains the seat portion 16 and the telescoping support means 44 in position relative to one another when the chair and exercise apparatus 10*b* is not in use; otherwise, the weight of the user accomplishes this task.

Operation of the Invention

The chair and exercise apparatus 10 of the present invention, when in the open position as shown in FIG. 1, may be used as a chair, with the user's feet either being inserted into the space between the cover 20 and the bottom 24, or extended over the top of the bottom 24. When the user wishes to use the chair and exercise apparatus 10 for purposes of exercise, the user reaches back and grasps the top 22 with his or her hands, and the user places his or her feet on the bottom 24. If the user is using the chair and exercise apparatus 10*b* shown in FIGS. 10 and 11, the user will first position the foot support 64 so that the open ends of the short portions 68 face each other, and the user will secure the foot support 64 into position relative to the seat portion 16 either by inserting the spring-loaded pin 76 into the appropriate hole 70, or by inserting a pin or rod (not shown) through the appropriate hole 70 and into the corresponding hole 74. Once the user has secured the foot supports 64 into position, the user will then place his or her feet onto the short portions 68.

To commence exercising/stretching, the user may arch his or her back in a backwards direction, so that the angle between the top of the seat portion 16 and the top of the back portion 18 increases, with the back portion 18 rotating about rotation apparatus 54. The user may continue to arch his or her back so that the user goes beyond the prone position, with the angle between the top of the seat portion 16 and the top of the back portion 18 exceeding 180 degrees. This action has the effect of stretching the user's back. Additionally, or in combination with the arching of the back, the user may bend or crunch his or her body forward, so that the angle between the top of the seat portion 16 and the top of the back portion 18 decreases. This action has the effect of exercising the abdominal region of the user. For aerobic benefits, the user may perform a series of back arches and forward crunches. As shown in FIG. 6, the telescoping support means 44 pivot in a back and forth direction during exercise.

When the user wishes to collapse the chair and exercise apparatus 10 or 10*b*, the user rotates the longerons about the bolt 42 so at to bring the first and second rectangular portions 34 and 36 together. While the first and second rectangular portions 34 and 36 are being brought closer together to achieve the position shown in FIG. 8, the male connecting member 46 will retract partially from the L-shaped connecting member 48.

While the invention has been particularly shown and described with reference to preferred embodiments thereof, it will be understood by those skilled in the art that the foregoing and other changes in form and details may be made therein without departing from the spirit and scope of the invention.

We claim:

1. A combination chair and exercise apparatus comprising, in combination:

an exercise chair comprising the following features:

seat means for supporting a lower portion of a person's body;

said seat means comprising foot support means for supporting both feet of a person Using said combination chair and exercise apparatus;

back support means coupled to said seat means for supporting an upper portion of a person's body;

said back support means comprising handle means located at an upper portion of said back support means for permitting a person using said combination chair and exercise apparatus to grasp and maneuver said back support means;

rotatable coupling means located at a confluence of said seat means and said back support means for permitting said seat means and said back support means to move relative to one another;

base means rotationally coupled to lower side portions of said back support means for supporting said back support means and for permitting said back support means to rotate relative to said base means and relative to said seat means;

said base means further comprise stabilizing means located at a bottom portion of said base means for further stabilizing said base means during use of said combination chair and exercise apparatus;

said stabilizing means comprise substantially L-shaped members fixedly connected to said bottom portion of said base means;

pivoting coupling means coupling said base means and said seat means for supporting said seat means and for permitting said seat means to move relative to said back support means; and said pivoting coupling means are coupled to said base means at a location that is below said seat means.

2. A combination chair and exercise apparatus comprising, in combination:

seat means for supporting a lower portion of a person's body;

said seat means comprising foot support means for supporting both feet of a person using said combination chair and exercise apparatus;

back support means coupled to said seat means for supporting an upper portion of a person's body;

said back support means comprising handle means located at an upper portion of said back support means for permitting a person using said combination chair and exercise apparatus to grasp and maneuver said back support means;

rotatable coupling means located at a confluence of said seat means and said back support means for permitting said seat means and said back support means to move relative to one another;

base means rotationally coupled to lower side portions of said back support means for supporting said back support means and for permitting said back support means to rotate relative to said base means and relative to said seat means;

pivoting coupling means coupling said base means and said seat means for supporting said seat means and for permitting said seat means to move relative to said back support means; and wherein said pivoting coupling means comprises male and female connecting members wherein said male and female connecting members are telescopically coupled together at a first end of each of said male and female connecting members, a second end of said male connecting member is coupled to one of a group comprising said base means and said seat means, and a second end of said female connecting member is coupled to one of a group comprising said base means and said seat means.

3. A method for providing a combination chair and exercise apparatus comprising the steps of:

providing an exercise chair comprising the following steps:

providing seat means for supporting a lower portion of a person's body;

said seat means comprising foot support means for supporting both feet of a person using said combination chair and exercise apparatus;

providing back support means coupled to said seat means for supporting an upper portion of a person's body;

said back support means comprising handle means located at an upper portion of said back support means for permitting a person using said combination chair and exercise apparatus to grasp and maneuver said back support means;

providing rotatable coupling means located at a confluence of said seat means and said back support means for permitting said seat means and said back support means to move relative to one another;

providing base means rotationally coupled to lower side portions of said back support means for supporting said back support means and for permitting said back support means to rotate relative to said base means and relative to said seat means;

providing stabilizing means located at a bottom portion of said base means for further stabilizing said base means during use of said combination chair and exercise apparatus;

said stabilizing means comprising substantially L-shaped members fixedly connected to said bottom portion of said base means;

providing pivoting coupling means coupling said base means and said seat means for supporting said seat means and for permitting said seat means to move relative to said back support means; and said pivoting coupling means are coupled to said base means at a location that is below said seat means.

4. A method for providing a combination chair and exercise apparatus comprising the steps of:

providing seat means for supporting a lower portion of a person's body;

said seat means comprising foot support means for supporting both feet of a person using said combination chair and exercise apparatus;

providing back support means coupled to said seat means for supporting an upper portion of a person's body;

said back support means comprising handle means located at an upper portion of said back support means for permitting a person using said combination chair and exercise apparatus to grasp and maneuver said back support means;

providing rotatable coupling means located at a confluence of said seat means and said back support means for permitting said seat means and said back support means to move relative to one another;

providing base means rotationally coupled to lower side portions of said back support means for supporting said back support means and for permitting said back support means to rotate relative to said base means and relative to said seat means;

providing pivoting coupling means coupling said base means and said seat means for supporting said seat means and for permitting said seat means to move relative to said back support means; and wherein the step of providing said pivoting coupling means further comprises the step of providing said pivoting coupling means comprising male and female connecting members wherein said male and female connecting members are telescopically coupled together at a first end of each of said male and female connecting members, a second end of said male connecting member is coupled to one of a group comprising said base means and said seat means, and a second end of said female connecting member is coupled to one of a group comprising said base means and said seat means.

* * * * *